US007152971B2

(12) United States Patent
Kumagai et al.

(10) Patent No.: US 7,152,971 B2
(45) Date of Patent: Dec. 26, 2006

(54) POSITIONING STRUCTURE IN IMAGE FORMING APPARATUS

(75) Inventors: Yukitaka Kumagai, Iruma (JP); Tatsutoshi Hashimoto, Machida (JP); Hiroshi Hashi, Tokyo (JP)

(73) Assignee: Olympus Corporation, Tokyo (JP)

( * ) Notice: Subject to any disclaimer, the term of this patent is extended or adjusted under 35 U.S.C. 154(b) by 233 days.

(21) Appl. No.: 10/979,944

(22) Filed: Nov. 1, 2004

(65) Prior Publication Data

US 2005/0093921 A1 May 5, 2005

(30) Foreign Application Priority Data

Nov. 5, 2003 (JP) ..... 2003-375942

(51) Int. Cl.

| | |
|---|---|
| ***B41J 2/155*** | (2006.01) |
| ***B41J 2/01*** | (2006.01) |
| ***B41J 29/00*** | (2006.01) |
| ***B65H 5/02*** | (2006.01) |

(52) U.S. Cl. ..... 347/104; 400/691; 400/635; 347/42; 347/108

(58) Field of Classification Search ..... None
See application file for complete search history.

(56) References Cited

U.S. PATENT DOCUMENTS

| | | | | |
|---|---|---|---|---|
| 5,245,364 | A * | 9/1993 | Uchida et al. | 347/104 |
| 6,827,436 | B1 * | 12/2004 | Nitta et al. | 347/108 |
| 6,910,766 | B1 * | 6/2005 | Haug | 347/104 |

FOREIGN PATENT DOCUMENTS

| | | | |
|---|---|---|---|
| JP | 08108588 | A * | 4/1996 |
| JP | 2000-062995 | A | 2/2000 |
| JP | 2000-158637 | A | 6/2000 |
| JP | 2001260464 | A * | 9/2001 |
| JP | 2002316443 | A * | 10/2002 |
| JP | 2003175591 | A * | 6/2003 |

* cited by examiner

*Primary Examiner*—Daniel J. Colilla
(74) *Attorney, Agent, or Firm*—Frishauf, Holtz, Goodman & Chick, P.C.

(57) ABSTRACT

On a carriage which a plurality of ink heads are arranged and from which an arm rotatable supporting an introduction roller for an image forming medium extends on an upstream side of a conveying path of the image forming medium; a conveying mechanism which is provided under the carriage in such a manner as to face the carriage and which conveys the image forming medium on a downstream side of the conveying path; and a plurality of regulation sections arranged in the carriage and the conveying mechanism respectively, wherein a positional relation between the carriage and the conveying mechanism is regulated by contacts among the plurality of regulation sections.

23 Claims, 6 Drawing Sheets

POSITIONING STRUCTURE IN IMAGE FORMING APPARATUS

CROSS-REFERENCE TO RELATED APPLICATIONS

This application is based upon and claims the benefit of priority from prior Japanese Patent Application No. 2003-375942, filed Nov. 5, 2003, the entire contents of which are incorporated herein by reference.

BACKGROUND OF THE INVENTION

1. Field of the Invention

The present invention relates to an image forming apparatus which ejects ink liquids of colors from a plurality of ink heads to form an image on an image forming medium, and relates to a positioning structure of an image forming apparatus in which displacements of superimposed colors by shifts of position of an image forming medium conveyed under a plurality of ink heads are eliminated.

2. Description of the Related Art

An image forming apparatus is comprised of the following image forming system. In the image forming system, a plurality of ink heads ejects ink liquids of different colors, that is, ink liquids of colors of black (K), cyan (C), magenta (M), and yellow (Y) to form an image on an image forming medium. The image forming apparatus comprises a conveying mechanism which conveys the image forming medium.

Four ink head groups which ejects the respective ink liquids of the colors of KCMY are provided above the conveying mechanism. Each of these ink head groups has a plurality of ink heads for the respective colors of KCMY. Therefore, a plurality of ink heads form one ink head group. The respective ink head groups are provided at predetermined intervals along a conveying direction of the image forming medium.

The conveying mechanism applies tensile forces, for example, to an endless band-shaped belt by a plurality of rollers, for example, three rollers to support the belt. In the conveying mechanism, a conveying-in side of the image forming medium is upstream, and a conveying-out side is downstream. For example, two rollers are provided on each of upstream and downstream sides. The remaining roller applies the tensile force to the belt. The roller on the downstream side is rotated/driven by a motor and the like. The roller on the upstream side moves following movement of the belt.

Therefore, when the roller on the downstream side is rotated/driven in the conveying mechanism, the belt moves. The image forming medium is laid on the belt, and conveyed by the movement of the belt. This conveying mechanism will be hereinafter referred to as a belt platen.

A pair of introduction rollers (hereinafter referred to as resist rollers) are provided on the conveying-in side (upstream side) of the belt platen. The resist roller is rotated/driven to introduce the image forming medium into the belt platen. Moreover, the resist roller regulates and corrects a posture such as a tilt of the image forming medium with respect to a conveying direction of the conveying mechanism.

In this image forming apparatus, the image forming medium is conveyed into the belt platen by a conveying force by the resist roller. When the image forming medium is conveyed into the belt platen, the image forming medium is adsorbed/held on the belt, and conveyed under the plurality of ink head groups with the movement of the belt. In this case, the resist roller freely rotates with respect to the image forming medium by a clutch function or the like. Accordingly, the image forming medium is conveyed under the plurality of ink head groups only by the conveying force by the belt platen.

The plurality of ink head groups ejects the respective ink liquids of KCMY. The respective ink liquids of KCMY are shot on the conveyed image forming medium. Accordingly, a full-color image is formed on the image forming medium.

A conveying direction of the image forming medium whose direction is regulated by the resist roller needs to agree with that of the image forming medium conveyed by the belt platen. If they do not agree with each other, positional shifts occur in color superimposition of the respective colors on the image forming medium at a time when the ink liquids of the respective colors are shot on the image forming medium to form the image.

For example, a technique concerning a recording apparatus such as a printer is described, for example, in Jpn. Pat. Appln. KOKAI Publication Nos. 2000-62995 and 2000-158637. It has been described in Jpn. Pat. Appln. KOKAI Publication No. 2000-62995 that a gap between a recording head and a sheet material is maintained constant, for example, regardless of a thickness of the sheet material as the image forming medium. In the Jpn. Pat. Appln. KOKAI Publication No. 2000-158637, a technique has been described in which recording paper can be securely prevented from being raised, and is stably discharged.

BRIEF SUMMARY OF THE INVENTION

According to a main aspect of the present invention, there is provided a positioning structure in an image forming apparatus, comprising: a conveying mechanism which conveys an image forming medium; a plurality of ink heads which spout ink liquids of different colors with respect to the image forming medium conveyed by the conveying mechanism; a carriage on which the plurality of ink heads are arranges at predetermined intervals substantially correct in parallel with one another and which is arranged position facing with position distant from the conveying mechanism; an introduction roller which regulates a conveying posture of the image forming medium to introduce the image forming medium into the conveying mechanism; at least two extending arms which are integrally provided on the carriage and which extend to an introducing side in the conveying mechanism to introduce the image forming medium and which rotatable supporting the introduction roller; and a plurality of regulation units which are arranges to the carriage and the conveying mechanism respectively, and which regulate a positional relation between the carriage and the conveying mechanism by mutual contacts.

DETAILED DESCRIPTION OF THE INVENTION

An embodiment of the present invention will be described hereinafter with reference to the drawings.

Figure 1:
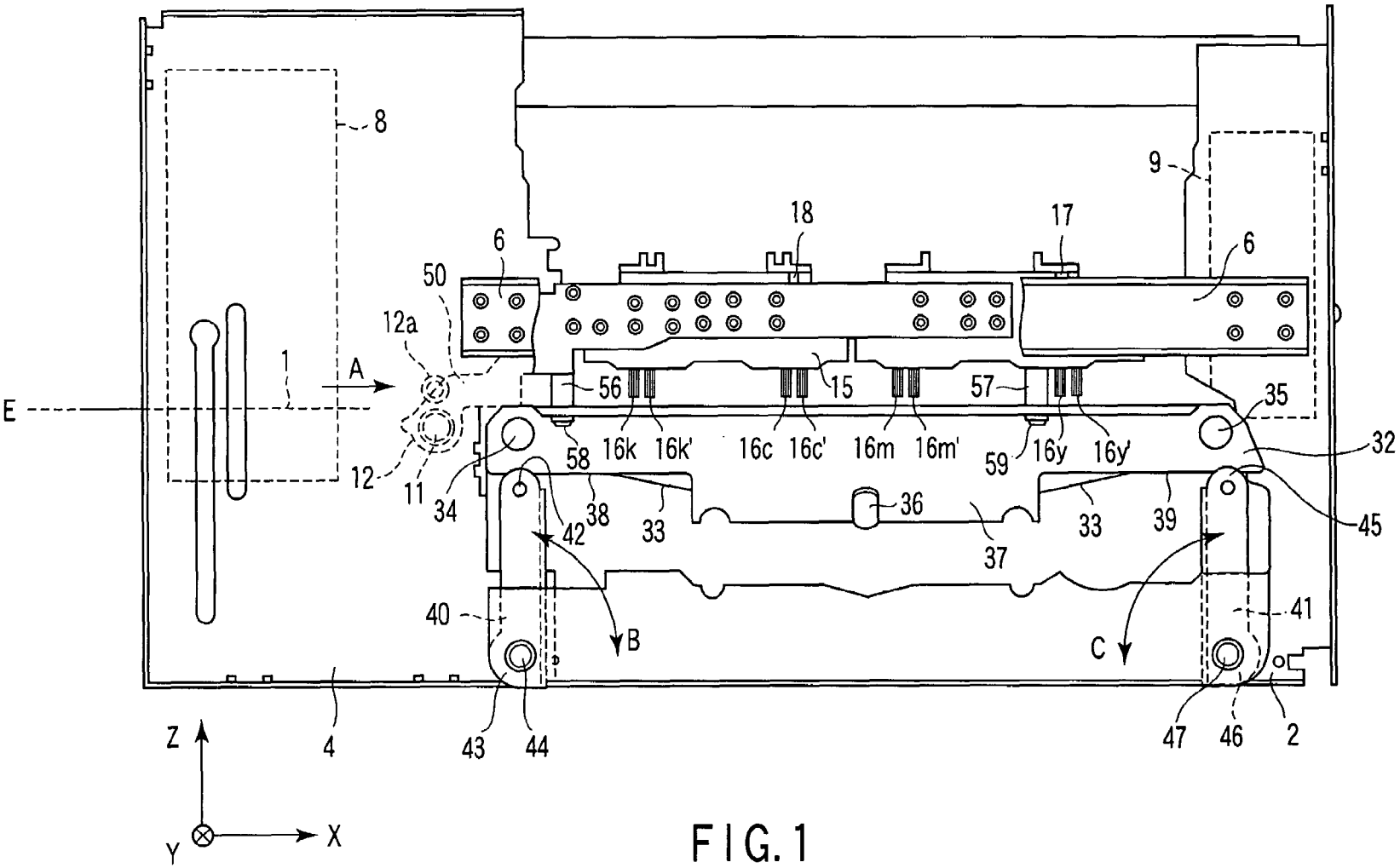
FIG. 1 is a side view showing an embodiment of a positioning structure of an image forming apparatus according to the present invention.
Figure 2:
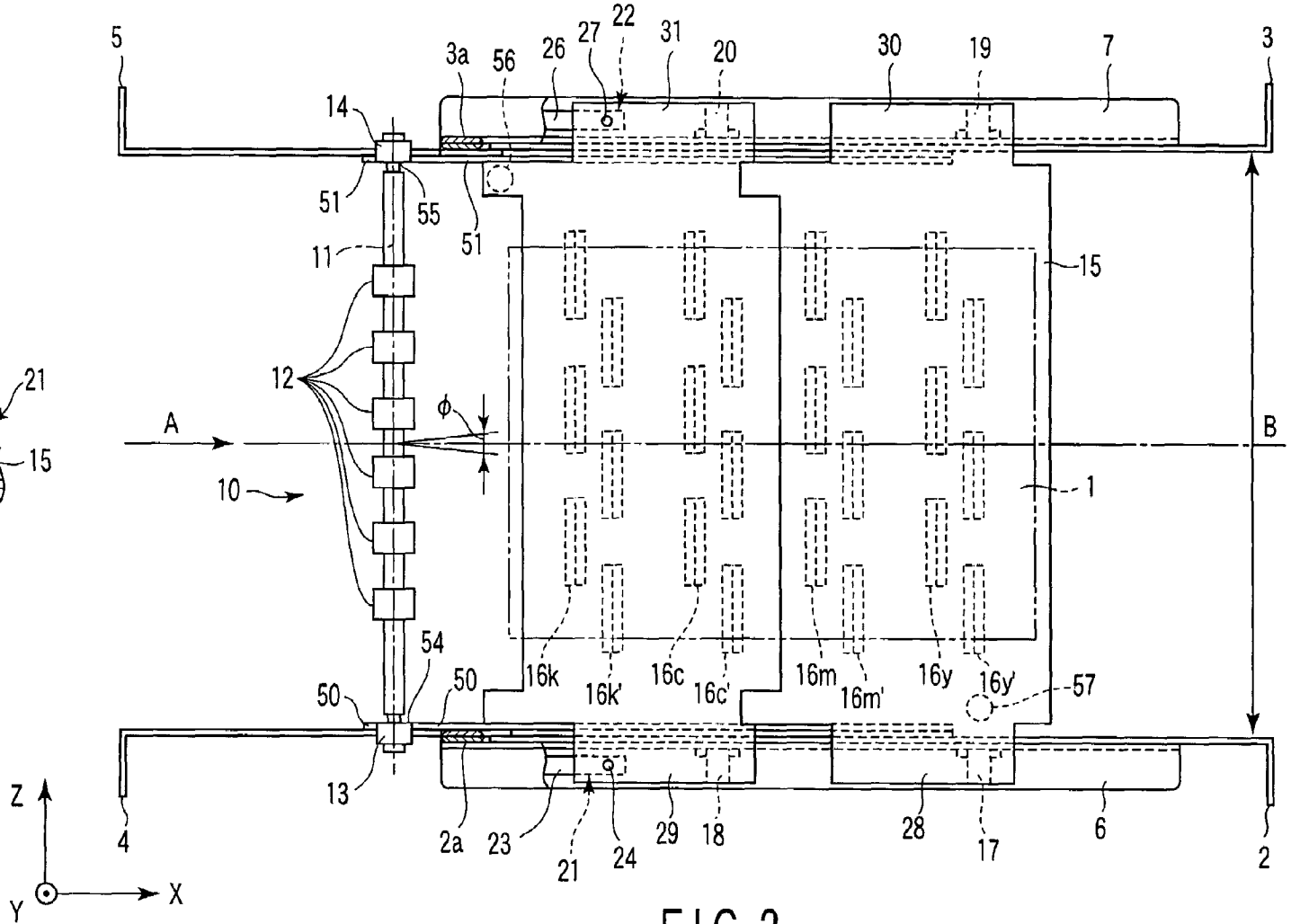
FIG. 2 is a plan view of a frame structure and carriage in the positioning mechanism.

FIGS. 1 and 2 are constitution diagrams showing a positioning structure in an image forming apparatus. FIG. 1 shows a side view, and FIG. 2 is a plan view of a carriage and around a frame. A conveying direction A of an image forming medium 1 is set to an X-axis direction. A direction crossing the conveying direction A of the image forming medium 1 at right angles is set to a Y-axis direction. A height direction of the image forming apparatus is set to a Z-axis direction.

Two first frames 2, 3 are provided along the X-axis direction on both side surfaces of the image forming apparatus. The respective first frames 2, 3 face each other at a predetermined interval B in the Y-axis direction as shown in FIG. 2. Each of the first frames 2, 3 is formed substantially into an L-shape as viewed from the side surface.

Second frames 4, 5 are provided on the insides of the first frames 2, 3. Each of the second frames 4, 5 is formed into a flat-plate shape. Rigidities of the second frames 4, 5 is larger than those of the first frames 2, 3.

One end of each of connecting frames 6, 7 is fixed to the second frames 4, 5, and the other end of the frame is fixed to the first frames 2, 3 with screws, so that the second frames 4, 5 are connected to the first frames 2, 3. The respective connecting frames 6, 7 are provided substantially between the second frames 4, 5 in a height direction (Z-axis direction) as shown in FIG. 1.

As shown in FIG. 1, the first and second frames 2 to 5 hold a supply unit 8, a discharge unit 9, an ink replenishing mechanism which replenishes ink liquids of KCMY colors, and an electrical system requiring a control circuit and the like.

The supply unit 8 supplies the image forming medium 1 into a space defined by the first and second frames 2 to 5, that is, into an image forming apparatus main body. For example, when the image forming medium 1 is a recording sheet, the supply unit 8 is a sheet supply unit.

The discharge unit 9 discharges the image forming medium 1 to the outside of the image forming apparatus main body. For example, when the image forming medium 1 is a recording sheet, the discharge unit 9 is a sheet discharge unit.

The respective first frames 2, 3 are fixed to the respective second frames 4, 5 in fixing portions 2*a*, 3*a* with screws on a conveying-in side of the image forming medium 1.

A resist roller 10 is rotatably supported between the second frames 4, 5. The resist roller 10 is provided in a direction crossing the conveying direction A of the image forming medium 1 substantially at right angles.

The resist roller 10 comprises a shaft 11, and a plurality of rollers 12 arranged at each predetermined interval on the shaft 11. The respective rollers 12 preferably have a large coefficient of friction with respect to the image forming medium 1. Both end portions of the shaft 11 of the resist roller 10 are rotatably supported by the second frames 4, 5 via bearings 13, 14. The respective bearings 13, 14 are fitted and fixed to the second frames 4, 5. In a height position E in which the resist roller 10 is supported, an upper end surface of each roller 12 is substantially matched with a height position of a belt 33 in a belt platen 32. Each roller 12 is provided with a roller 12*a* to form a pair.

On a carriage 15, a plurality of ink heads 16*k*, 16*k*', 16*c*, 16*c*', 16*m*, 16*m*', 16*y*, 16*y*' (hereinafter referred to as the respective ink heads 16*k*, 16*k*', . . . 16*y*') are mounted. The respective ink heads 16*k*, 16*k*', . . . 16*y*' ejects ink liquids of KCMY colors. The ink heads 16*k*, 16*k*' spout the ink liquids of color K. The ink heads 16*c*, 16*c*' ejects the ink liquids of color C. The ink heads 16*m*, 16*m*' spout the ink liquids of color M. The ink heads 16*y*, 16*y*' ejects the ink liquids of color Y.

The respective ink heads 16*k*, 16*k*', . . . 16*y*' have nozzle rows which ejects the respective ink liquids of the colors. The nozzle rows are provided on lower surfaces (hereinafter referred to as the nozzle formed surfaces) of the respective ink heads 16*k*, 16*k*', . . . 16*y*'. In each nozzle row, a plurality of nozzles are arranged, for example, in one line. The respective ink heads 16*k*, 16*k*', . . . 16*y*' are mounted on the carriage 15 while the respective nozzle rows are directed downwards (in the Z-axis direction).

As to the respective ink heads 16*k*, 16*k*', . . . 16*y*', for example, as shown in FIG. 2, two rows of three heads per row, six heads in total are provided for each of the ink colors KCMY in the Y-axis direction crossing the conveying direction A of the image forming medium 1 at right angles. If all of the ink heads 16*k*, 16*k*', . . . 16*y*' are denoted with reference numerals, the drawing is intricate, and therefore only the ink head provided in each end portion is denoted with each of reference numerals 16*k*, 16*k*', . . . 16*y*' in FIG. 2.

For example, six ink heads 16*k*, 16*k*', . . . form an ink head group of the color K, six ink heads 16*c*, 16*c*', . . . form an ink head group of the color C, six ink heads 16*m*, 16*m*', . . . form an ink head group of the color M, and six ink heads 16*y*, 16*y*', . . . form an ink head group of the color Y.

The ink heads 16*k*, 16*k*', . . . 16*y*' are alternately arranged for each of the ink colors KCMY in the X-axis direction, and are arranged with a predetermined mutual overlap in each nozzle row in the Y-axis direction. Accordingly, a region in which any image is not formed is not generated at a time when an image is formed with respect to the image forming medium 1.

Abutment portions 17, 18 are provided on the upper surface of the connecting frame 6. Abutment portions 19, 20 are provided on the upper surface of the connecting frame 7. Carriage guide mechanisms 21, 22 are provided under the respective connecting frames 6, 7 on the conveying-in side of the image forming medium 1.

Figure 3:
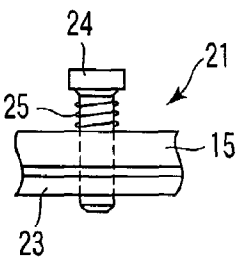
FIG. 3 is a constitution diagram showing a carriage guide mechanism in the positioning structure.

FIG. 3 shows a constitution diagram showing of the carriage guide mechanism 21. The carriage guide mechanism 21 has a guide support plate 23, an adjustment screw 24 screwed into the guide support plate 23, and a coil spring 25 fitted to the adjustment screw 24. The carriage guide mechanism 22 also has a guide support plate 26, an adjustment screw 27, and a coil spring in the same manner as in the carriage guide mechanism 21. The coil spring is not denoted with any reference numeral and omitted for convenience of the drawing.

As shown in FIG. 2, extended portions 28 to 31 are provided on both sides of the carriage 15 in the Y-axis direction. The extended portion 28 of the carriage 15 abuts on the abutment portion 17. The extended portion 29 of the carriage 15 abuts on the abutment portion 18. The extended portion 30 of the carriage 15 abuts on the abutment portion 19. The extended portion 31 of the carriage 15 abuts on the abutment portion 20.

When the adjustment screw 24 of the carriage guide mechanism 21 is inserted through the extended portion 29 of the carriage 15, and fitted into the guide support plate 23, an upper portion of the extended portion 29 is pressed downwards by the coil spring 25 in the Z-axis direction. When the adjustment screw 27 of the carriage guide mechanism 22 is inserted through the extended portion 31 of the carriage 15, and fitted into the guide support plate 26, the upper portion of the extended portion 31 is pressed downwards by the coil spring in the Z-axis direction. Accordingly, the carriage 15 is laid on the respective connecting frames 6, 7.

The respective carriage guide mechanisms 21, 22 press the carriage 15 in such a manner that the carriage abuts on the respective abutment portions 17 to 20 on the connecting frames 6, 7, and regulates movement of the carriage 15 in the height direction (Z-axis direction).

The belt platen 32 conveys the image forming medium 1 in the conveying direction A at a certain conveying speed. The conveying-in side of the image forming medium 1 is upstream, and the conveying-out side is downstream. The belt platen 32 supports, for example, the endless band-shaped belt 33 by a plurality of rollers, for example, three platen rollers 34, 35, 36 while applying tensile forces to the belt.

For example, the platen roller 34 is provided on an upstream side. The platen roller 35 is provided on a downstream side. The platen roller 36 applies the tensile force to the belt 33. The platen roller 35 on the downstream side is rotated/driven by a motor or the like. The platen roller 34 on the upstream side follows the movement of the belt 33, and is rotated. The roller 34 on the upstream side is connected to, for example, an encoder or the like to generate a movement amount of the belt 33. A plurality of holes are provided in the belt 33. Each hole sucks in air. Accordingly, the image forming medium 1 is adsorbed/held on the belt 33.

Therefore, the belt platen 32 moves the belt 33 by rotating/driving of the roller 35 on the downstream side. Since the image forming medium 1 is laid on the belt 33, the medium is conveyed at a constant conveying speed in the conveying direction A by the movement of the belt 33.

The belt platen 32 is provided in such a manner as to face the nozzle formed surfaces of the respective ink heads 16*k*, 16*k*', . . . 16*y*' mounted on the carriage 15. The belt platen 32 is vertically movable in the Z-axis direction.

Side plates 37 are provided on the opposite side surfaces of the belt platen 32. FIG. 1 shows only one side plate 37 for the convenience of the drawing. Lower-end edges 38, 39 are formed on lower ends of the side plate 37 on the upstream and downstream sides. Each of the lower-end edges 38, 39 is linearly formed substantially in parallel with a surface on which the image forming medium 1 is laid on the belt 33, for example, in the X-axis direction.

Platen vertical mechanism arms 40, 41 are provided under the lower-end edges 38, 39. The belt platen 32 is laid on the platen vertical mechanism arms 40, 41. The platen vertical mechanism arms 40, 41 abut on the lower-end edges 38, 39 of the belt platen 32 to support the belt platen 32. The platen vertical mechanism arms 40, 41 are slidable with respect to the lower-end edges 38, 39 of the belt platen 32. The platen vertical mechanism arms 40, 41 are formed into plate shapes.

For example, a roller is rotatably provided on one end 42 of the platen vertical mechanism arm 40. The roller is slidable with respect to the lower-end edge 38. A shaft 44 is provided on the other end 43 of the platen vertical mechanism arm 40. The shaft 44 is provided in the first frame 2. The platen vertical mechanism arm 40 is rotatably supported centering on the shaft 44 in an arrow B direction.

For example, a roller is rotatably provided on one end 45 of the platen vertical mechanism arm 41. The roller is slidable with respect to the lower-end edge 39. A shaft 47 is provided on the other end 46 of the platen vertical mechanism arm 41. The shaft 47 is provided in the first frame 2. The platen vertical mechanism arm 41 is rotatably supported centering on the shaft 47 in an arrow C direction.

Figure 4:
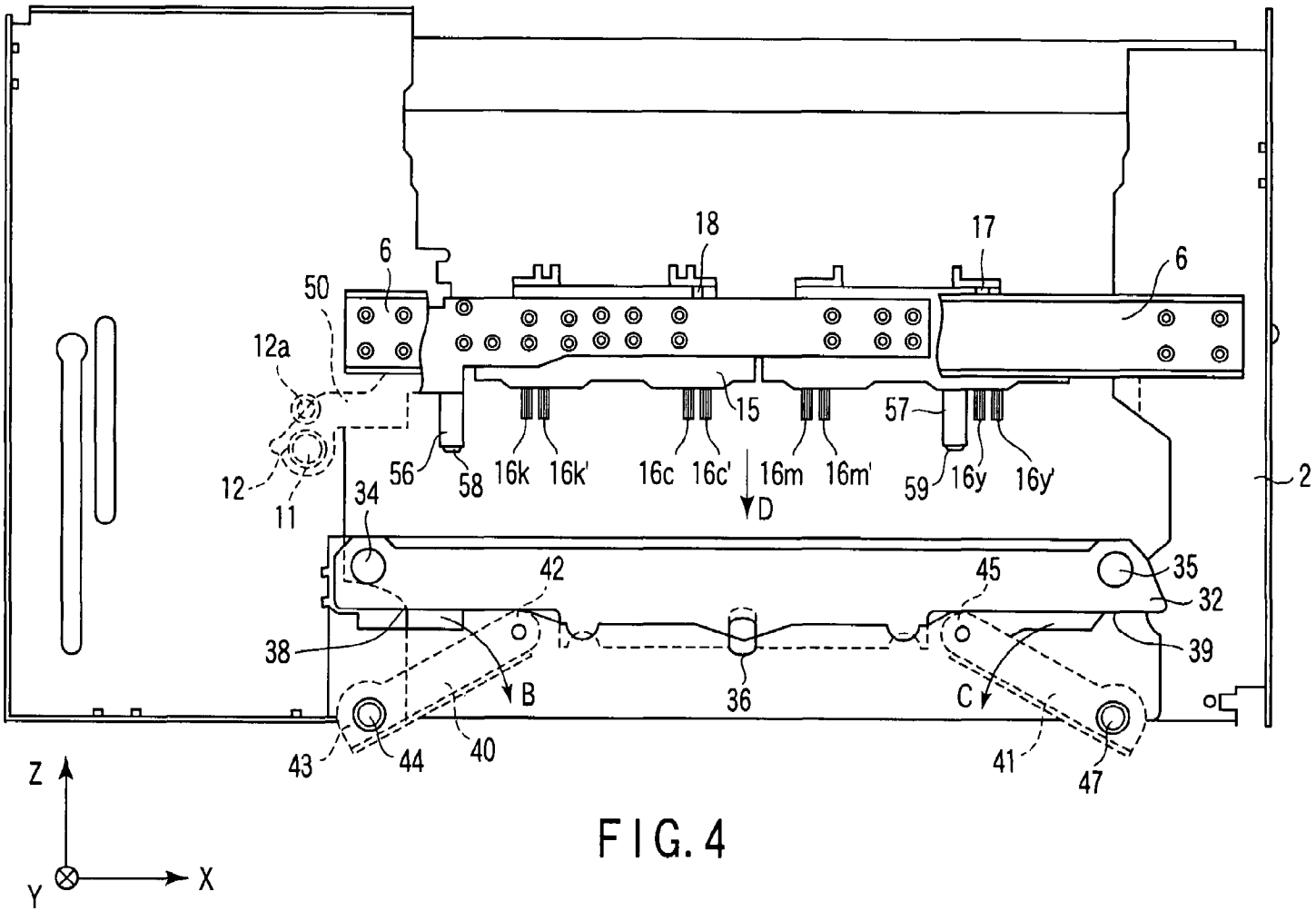
FIG. 4 is a diagram showing a moving-up/down operation of a belt platen in the positioning structure.

The respective platen vertical mechanism arms 40, 41 rotates/operates synchronously with each other. When the platen vertical mechanism arms 40, 41 synchronously rotate, as shown in FIG. 4, each one end 42, 45 of the platen vertical mechanism arm 40, 41 slides on the lower-end edge 38, 39 of the belt platen 32. Accordingly, the belt platen 32 moves down in an arrow D direction (Z-axis direction).

When the image is formed on the image forming medium 1, the belt platen 32 moves to a position for forming the image, and therefore the respective platen vertical mechanism arms 40, 41 synchronously rotate upwards as shown in FIG. 1. Accordingly, the belt platen 32 moves up in the Z-axis direction. As a result, an interval between the belt platen 32 and the respective nozzle formed surfaces of the ink heads 16*k*, 16*k*', . . . 16*y*' is narrowed to a preset interval for forming the image.

When the image forming medium 1 jams between the carriage 15 and the belt platen 32, the image forming medium 1 cannot be conveyed. An operation (jam treatment) of removing the jammed image forming medium 1 is performed. For example, when the jam occurs, a maintenance operation such as a jam treatment is performed.

In this case, the respective platen vertical mechanism arms 40, 41 synchronously rotate downwards as shown in FIG. 4. Accordingly, the belt platen 32 moves down in the Z-axis direction. As a result, an interval between the belt platen 32 and each nozzle row of the respective ink heads 16*k*, 16*k*', . . . 16*y*' is expanded to a preset interval for maintenance.

Carriage arms 50, 51 are provided on the opposite side surfaces of the carriage 15. The carriage arms 50, 51 obliquely extend downwards on the conveying-in side of the image forming medium 1.

As shown in FIG. 2, a support hole 54 is provided in the carriage arm 50.

As shown in FIG. 2, a support hole 55 is provided in the carriage arm 51. Outer sides (outer races) of the bearings 13, 14 are fitted and fixed into the support holes 54, 55. Both sides of the shaft 11 in the resist roller 10 are forced into inner sides (inner races) of the bearings 13, 14.

The carriage arms 50, 51 rotatably support the resist roller 10 in a direction crossing the conveying direction A of the image forming medium 1 at right angles.

Therefore, the resist roller 10 is integrally provided in the carriage 15 by the respective carriage arms 50, 51.

Carriage pins 56, 57 for regulating a position are fixed to the carriage 15 in such a manner as to vertically extend down in the Z-axis direction. The carriage pin 56 is provided on the upstream side of the conveying direction A of the image forming medium 1 in the carriage 15. The carriage pin 57 is provided on the downstream side of the conveying direction A of the image forming medium 1 in the carriage 15. The respective carriage pins 56, 57 are provided in diagonal positions in a plane parallel to that along which the image forming medium 1 is conveyed as shown in FIG. 2.

The carriage pins 56, 57 are formed into columnar shapes by materials having high rigidities. Conical portions 58, 59 are formed on the lower end portions of the carriage pins 56, 57.

Figure 6:
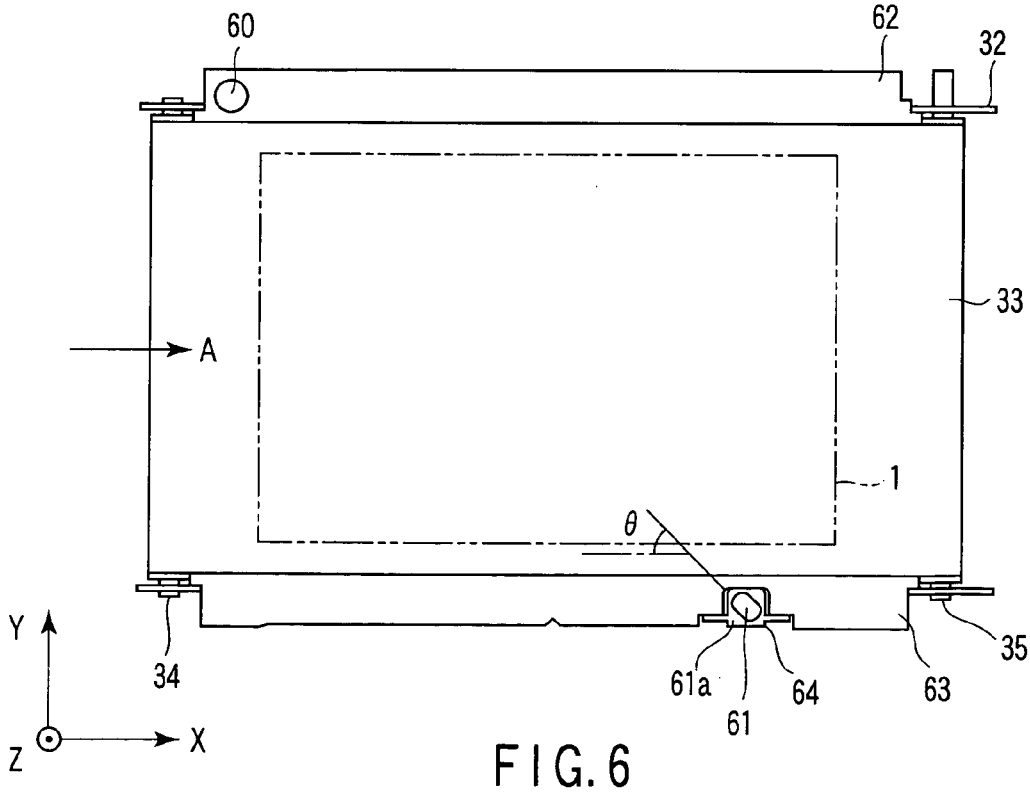
FIG. 6 is a diagram showing a position of a positioning hole in the positioning structure.

As shown in FIG. 6, positioning holes 60, 61 for regulating the position are provided in the belt platen 32. The respective positioning holes 60, 61 are provided in positions facing the carriage pins 56, 57. The positioning holes 60, 61 are provided in edge portions 62, 63 of the belt platen 32. The positioning holes 60, 61 are provided in the diagonal positions in the plane parallel to a plane along which the image forming medium 1 is conveyed.

One positioning hole 60 is provided on the conveying upstream side of the image forming medium 1. The other positioning hole 61 is provided on the conveying downstream side of the image forming medium 1.

The carriage pin 56 is fitted into one positioning hole 60. The positioning hole 60 is formed to be circular. A diameter of the positioning hole 60 is formed to be substantially equal to that of the carriage pin 56 in such a manner that the pin can be fitted.

The carriage pin 57 is fitted into the other positioning hole 61. The positioning hole 61 is formed into an elongated hole shape. Accordingly, a fitting degree between the positioning hole 61 and the carriage pin 57 is lower than that between the positioning hole 60 and the carriage pin 56. A short diameter of the positioning hole 61 is formed to be substantially equal to the diameter of the carriage pin 57. A long diameter of the positioning hole 61 is formed to be larger than the diameter of the carriage pin 57 by a predetermined length.

When the image is formed on the image forming medium 1, the belt platen 32 is moved (Z-axis direction) to a position where the interval between the belt platen 32 and each nozzle formed surface of the respective ink heads 16*k*, 16*k*', . . . 16*y*' is narrowed to a preset interval for forming the image. In this case, the carriage pin 56 fits into the positioning hole 60. Moreover, the carriage pin 57 fits into the positioning hole 61.

When the carriage pin 56 fits into the positioning hole 60, and the carriage pin 57 fits into the positioning hole 61, a positional shift sometimes occurs between the carriage 15 and the belt platen 32.

The long diameter of the positioning hole 61 having an elongated hole shape is formed into a length in accordance with a positional shift amount between the carriage 15 and the belt platen 32. Accordingly, even when the positional shift occurs between the carriage 15 and the belt platen 32, the carriage pin 56 fits into the positioning hole 60, and the carriage pin 57 easily fits into the positioning hole 61.

Therefore, the carriage 15 and the belt platen 32 are positioned with respect to each other.

The other positioning hole 61 in a long-diameter direction is formed in such a manner as to tilt at a predetermined angle θ, for example, 45° with respect to the conveying direction A of the image forming medium 1. Accordingly, even when the belt platen 32 shifts from the carriage 15 in the X-axis direction or the Y-axis direction, the carriage pin 56 easily fits into the positioning hole 60.

A position adjustment mechanism 64 is provided on the edge portion 63 of the belt platen 32. The position adjustment mechanism 64 is capable of varying the position of the positioning hole 61 within a plane of an XY-axis. The position adjustment mechanism 64 moves a movable plate 61*a* in which the positioning hole 61 is provided within the plane of the XY-axis. The position adjustment mechanism 64 moves the position of the positioning hole 61 in an XY-axis direction, for example, in a case where the carriage pin 57 tightly fits into the positioning hole 61. The position adjustment mechanism 64 may be provided preferably in the positioning hole 61 distant from the resist roller 10 among the respective positioning holes 60, 61. The mechanism does not have to be provided depending on a long-diameter dimension of the positioning hole 61.

The respective carriage pins 56, 57 fit into the belt platen 32. Accordingly, the carriage pins 56, 57 regulate a positional relation between the carriage 15 and the belt platen 32. The carriage pins 56, 57 substantially match a conveying posture of the image forming medium 1 introduced by the resist roller 10 with that of the image forming medium 1 by the belt platen 32. The respective positioning holes 60, 61 are not restricted to the diagonal positions, and may be linearly provided in the X or Y-direction.

Next, positioning adjustment of the image forming apparatus will be described.

In a first step, the vertical mechanism platen arms 40, 41 synchronously rotate upward centering on the shafts 44, 47, respectively. By the rotations of the vertical mechanism platen arms 40, 41, as shown in FIG. 1, the belt platen 32 is lifted up and moves. Accordingly, the belt platen is positioned in such a manner that the interval between the belt platen 32 and each nozzle formed surface of the respective ink heads 16*k*, 16*k*', . . . 16*y*' in the carriage 15 is narrowed to the preset interval for forming the image.

Figure 5:
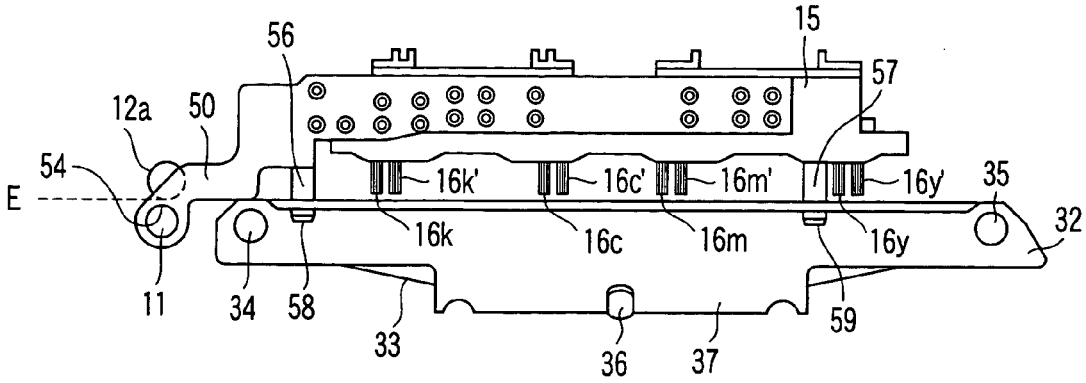
FIG. 5 is a constitution diagram showing a carriage arm, carriage, and belt platen which support a resist roller in the positioning structure.

Moreover, as shown in FIGS. 5 and 6, the carriage pins 56, 57 provided on the carriage 15 fit into the positioning holes 60, 61 in the belt platen 32, respectively. Accordingly, the belt platen 32 is positioned with respect to the carriage 15.

In this case, one carriage pin 56 fits in the circular positioning hole 60. The carriage pin 56 fits into the positioning hole 60 with a high fitting degree. The other carriage pin 57 fits into the elongated positioning hole 61. The carriage pin 57 fits into the positioning hole 61 with a low fitting degree.

For example, the belt platen 32 laid on the vertical mechanism platen arms 40, 41 sometimes moves in the XY-axis plane direction during vertical movement or the like. The carriage 15 also sometimes moves in the XY-axis plane direction by deformation of the fixing portion or the like. Accordingly, a shift in the positional relation occurs between the carriage 15 and the belt platen 32. By this positional shift, each positional relation between the carriage pins 56, 57 and the positioning holes 60, 61 also shifts.

Even when this positional shift occurs, the respective carriage pins 56, 57 are fitted into the positioning holes 60, 61.

As a result, the carriage 15 and the belt platen 32 are mutually positioned in such a manner that a movement amount in mutual movement of the XY-axis plane direction is eliminated (mutual movement amount is substantially zeroed).

It is to be noted that when the carriage pin 57 tightly fits into the positioning hole 61, the position of the positioning hole 61 is moved in the XY-axis plane and finely adjusted by the position adjustment mechanism 64. Accordingly, the carriage pin 57 is fitted into the positioning hole 61.

Next, the process shifts to a second step. The image forming medium 1 is supplied into the image forming apparatus main body for evaluation of image formation. The conveying posture of the image forming medium 1 is determined, when the resist roller 10 stands still. Thereafter, the image forming medium 1 is introduced into the belt platen 32 by the conveying force of the resist roller 10.

When the image forming medium 1 is introduced, the belt platen 32 adsorbs/holds the image forming medium 1 on the belt 33. The belt platen 32 moves the belt 33 by the rotating/driving of the roller 35 on the downstream side. Since the image forming medium 1 is adsorbed/held on the belt 33, the medium is conveyed in the conveying direction A at a constant conveying speed by the movement of the belt 33. Accordingly, the image forming medium 1 is conveyed under the respective ink heads 16*k*, 16*k*', . . . 16*y*'.

During the conveying of the image forming medium 1, the respective ink heads 16*k*, 16*k*', . . . 16*y*' eject the ink liquids of KCMY. The respective KCMY ink liquids are ejected on the image forming medium 1. Accordingly, the image is formed on the image forming medium 1.

Next, the process shifts to a third step. Superimposed color displacement of the respective colors on the image forming medium 1 on which the image has been formed is evaluated. For example, it is judged whether or not an ejection position of the ink liquid of the color K ejected from an n-th nozzle of the ink head 16*k* is superimposed on that of the ink liquid of the color Y spouted from the same n-th nozzle of the ink head 16*y*. If the ejection position of the ink liquid of the color K is not superimposed on that of the ink liquid of the color Y, it is evaluated that the conveying direction of the image forming medium 1 by the belt platen 32, and the direction crossing the respective ink heads 16*k*, 16*k*', . . . 16*y*' provided on the carriage 15 at right angles are not secured.

Next, the process shifts to a fourth step. An evaluation result of the superimposed color displacement, that is, a superimposed color displacement amount between the ejection positions of the ink liquids of the colors K and Y is obtained. When the superimposed color displacement is within an allowable range, it is judged that the positional relation between the carriage 15 and the belt platen 32 is within the allowable range, and the positioning ends. When the position adjustment mechanism 64 is provided, the position adjustment mechanism 64 is fixed to the edge portion 63 of the belt platen 32 with screws.

As a result of the evaluation of the superimposed color displacement, when the superimposed color displacement is out of the allowable range, and the position adjustment mechanism 64 is provided, the position of the positioning hole 61 is readjusted into a position facing the carriage pin 57. When the position adjustment mechanism 64 is not provided, the fixing portions 2*a*, 3*a* between the first frames 2, 3 and the second frames 4, 5 are adjusted.

Accordingly, a relative positional relation between the carriage 15 and the belt platen 32 is readjusted.

With regard to the carriage 15 and the belt platen 32, the evaluation result of the superimposed color displacement is not out of the allowable range, because the carriage pins 56, 57 are fitted into the positioning holes 60, 61.

When the positional relation between the carriage 15 and the belt platen 32 is adjusted (including the position adjustment of the positioning hole 61 by the position adjustment mechanism 64), the process returns to the second step again to form the image on the image forming medium 1.

Thereafter, as described above, in the third step, the superimposed color displacement of the respective colors on the image forming medium 1 on which the image has been formed is evaluated. The evaluation result of the superimposed color displacement is judged in the fourth step. When the superimposed color displacement is in the allowable range based on the evaluation result of the superimposed color displacement, the positioning of the carriage 15 and the belt platen 32 ends. When the superimposed color displacement is out of the allowable range even after the readjustment, the positional relation between the carriage 15 and the belt platen 32 is readjusted. Thereafter, the second to fourth steps are repeated.

When the positioning of the carriage 15 and the belt platen 32 ends, the resist roller 10 rotatably supported in parallel with the respective ink heads 16*k*, 16*k*', . . . 16*y*' and in a direction crossing the conveying direction A of the image forming medium 1 at right angles is positioned on the upstream side of the belt platen 32 by the carriage arms 50, 51 obliquely extending down from the carriage 15 on the conveying-in side of the image forming medium 1.

When the movement of the carriage 15 in the height direction (Z-axis direction) is regulated by the carriage guide mechanisms 21, 22 and the abutment portions 17 to 20 formed on the connecting frames 6, 7, the movement of the resist roller 10 integrally provided on the carriage 15 in the height direction (Z-axis direction) is similarly regulated.

The carriage 15 is in such a state that parallelism between the resist roller 10 and the respective ink heads 16*k*, 16*k*', . . . 16*y*' is held. The belt platen 32 holds a state of conveying the image forming medium 1 in a direction crossing the respective ink head groups 16*k*, 16*k*', . . . 16*y*' at right angles. While this state is held, the positioning of the carriage 15 and the belt platen 32 is possible.

As described above, according to the embodiment, the carriage pins 56, 57 are provided on the carriage 15 on which respective ink heads 16*k*, 16*k*', . . . 16*y*' are mounted, further the positioning holes 60, 61 are provided in the belt platen 32 which conveys the image forming medium 1, and the carriage pins 56, 57 are fitted into the positioning holes 60, 61 of the belt platen 32. Accordingly, the positional relation between the carriage 15 and the belt platen 32 can be regulated. The image can be formed without any superimposed-color image formation positional shift in the superimposed-color image formation of the KCMY colors.

The carriage pins 56, 57 are provided in the mutually diagonal positions. Accordingly, the positional relation between the carriage 15 and the belt platen 32 in the XY-axis direction is not displaced on the upstream and downstream sides in conveying the image forming medium 1 in the carriage 15.

For example, it is assumed that the first frames 2, 3 have been deformed by external shock, vibration or the like in a state in which the carriage 15 and the belt platen 32 are not fitted by the carriage pins 56, 57 and the positioning holes 60, 61.

In this case, the carriage 15 and the belt platen 32 are sometimes displaced in a horizontal direction (XY-axis plane direction).

The rigidities of the second frames 4, 5 are higher than those of the first frames 2, 3. Therefore, when the first frames 2, 3 are deformed in the fixing portions 2*a*, 3*a* between the first frames 2, 3 and the second frames 4, 5. the second frames 4, 5 are not deformed and maintain existing states. Moreover, the second frames 4, 5 integrally shift the carriage 15 including the resist roller 10 on the abutment portions 17 to 20 in the horizontal direction (angle $\phi$ direction shown in FIG. 2) using the fixing portions 2*a*, 3*a* as supporting points.

When the carriage pins 56, 57 fit into the positioning holes 60, 61 again, for example, the carriage 15 including the resist roller 10 functions in such a manner as to correct the deformations of the first frames 2, 3 via the fixing portions 2*a*, 3*a* in the process of the fitting. Accordingly, even if the first frames 2, 3 are deformed, the positional relations with respect to the belt platen 32 are kept while the positional relation between the resist roller 10 and the carriage 15 is kept.

As a result, the parallelism between the axial direction of the resist roller 10 and the respective ink heads 16*k*, 16*k*', . . . 16*y*' in the carriage 15 is kept, and orthogonality with respect to the conveying direction A of the image forming medium 1 by the belt platen 32 is kept.

When the image forming medium 1 is conveyed in during the operation of the image formation, the conveying posture of the image forming medium 1 is determined by the resist roller 10 to be at rest. Thereafter, the image forming medium 1 is introduced into the belt platen 32 by the conveying force of the resist roller 10.

When the image forming medium 1 is introduced, the belt platen 32 adsorbs/holds the image forming medium 1 onto the belt 33. The belt platen 32 moves the belt 33 by the rotating/driving of the roller 35 on the downstream side. Since the image forming medium 1 is adsorbed/held on the belt 33, the medium is conveyed in the conveying direction A at the constant conveying speed by the movement of the belt 33. Accordingly, the image forming medium 1 is conveyed under the respective ink heads 16*k*, 16*k*', . . . 16*y*'.

During the conveying of the image forming medium 1, the respective ink heads 16*k*, 16*k*', . . . 16*y*' eject the ink liquids of KCMY. The ink liquids of KCMY are ejected on the image forming medium 1. Accordingly, the image is formed on the image forming medium 1.

In this time, the axial direction of the resist roller 10 and the conveying direction A by the belt platen 32 mutually keep an orthogonal relation.

As a result, the superimposed color displacement of each color does not occur on the image forming medium 1.

At a maintenance time of the respective ink heads 16*k*, 16*k*', . . . 16*y*', the platen vertical mechanism arms 40, 41 synchronously rotate centering on the shafts 44, 47. Accordingly, the belt platen 32 moves downwards as shown in FIG. 4. The interval between the belt platen 32 and the nozzle formed surfaces of the respective ink heads 16*k*, 16*k*', . . . 16*y*' in the carriage 15 is expanded to a preset interval for the maintenance.

In this state, jam removal (jam treatment) of the image forming medium 1 on a conveying path, or maintenance of the respective ink heads 16*k*, 16*k*', . . . 16*y*' is performed.

After the end of the maintenance, the platen vertical mechanism arms 40, 41 synchronously rotate centering on the shafts 44, 47. Accordingly, the belt platen 32 is lifted upwards and moves. The belt platen is positioned in such a manner that the interval between the belt platen 32 and the nozzle formed surfaces of the respective ink heads 16*k*, 16*k*', . . . 16*y*' in the carriage 15 is narrowed to the preset interval for the image formation.

Also in this case, the respective carriage pins 56, 57 of the carriage 15 fit into the positioning holes 60, 61 of the belt platen 32. Accordingly, the positional relation among the resist roller 10, carriage 15, and belt platen 32 is kept. The mutual orthogonal relation is kept between the axial direction of the resist roller 10 and the conveying direction A by the belt platen 32.

Therefore, even when the carriage 15 is repeatedly attached/detached with respect to the belt platen 32 many times by the maintenance or the like, the positional relation among the resist roller 10, carriage 15, and belt platen 32 is kept.

Moreover, since the respective lower end portions of the carriage pins 56, 57 are formed by the conical portions 58, 59, the pins easily fit into the positioning holes 60, 61.

The present invention is not limited to the above-described embodiment, and may be modified as follows.

The belt platen 32 is vertically moved with respect to the carriage 15 in such a manner that the carriage pins 56, 57 are fitted into the positioning holes 60, 61 to position the carriage 15 and the belt platen 32, but the present invention is not limited to this. For example, the movement of at least the belt platen 32 in the vertical direction may be regulated, the resist roller 10 may be integrally supported by the belt platen 32, and the carriage 15 may be vertically movable.

The respective fitting positions of the carriage pins 56, 57 into the positioning holes 60, 61 are not limited to the diagonal positions, and may be provided in at least two or more places.

The respective carriage pins 56, 57 may be formed into conical shapes.

It is most satisfactory to dispose the respective carriage pins 56, 57 in the mutually diagonal positions with respect to the belt platen 32. The carriage pins 56, 57 may be provided in the following positions.

Figure 7:
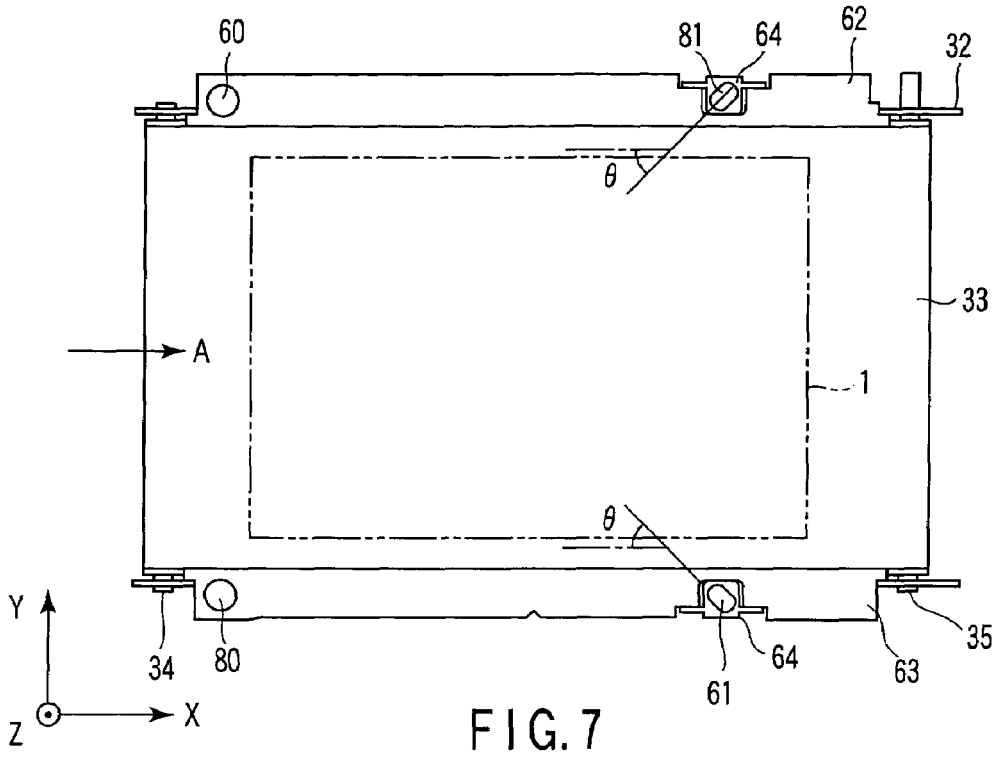
FIG. 7 is a diagram showing a modification of the position of the positioning hole in the positioning structure.

For example, as shown in FIG. 7, positioning holes 80, 81 are provided in positions in the both edge portions 62, 63 of the belt platen 32. The positioning hole 80 is a circular hole. The positioning hole 81 is an elongated hole. The positioning hole 81 is formed in such a manner that a direction of a long diameter is tilted at a predetermined angle $-\theta$, for example, $-45°$ with respect to the conveying direction A of the image forming medium 1. The positioning holes 80, 81 are provided in the diagonal positions of the carriage 15.

Therefore, four carriage pins are provided on the carriage 15 in such a manner as to face four positioning holes 60, 61, 80, 81.

The present invention is not limited to four positioning holes 60, 61, 80, 81, and only positioning holes 80, 81 may be provided. In this case, the carriage pins are provided facing the positioning holes 80, 81.

Tip portions of the carriage pins 56, 57 may have, for example, wedge shapes.

Figure 8:
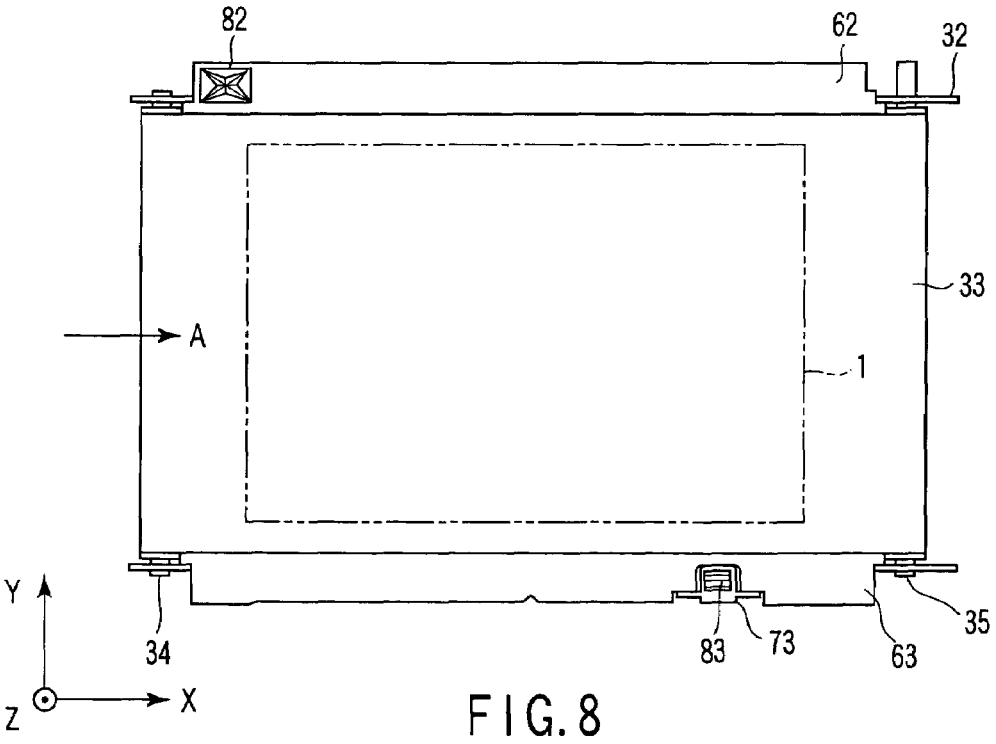
FIG. 8 is a diagram showing a position of a positioning groove in the positioning structure.

Positioning grooves 82, 83 are provided in the both edge portions 62, 63 of the belt platen 32 facing the carriage pins 56, 57 having wedge shapes as shown in FIG. 8.

Figure 9:
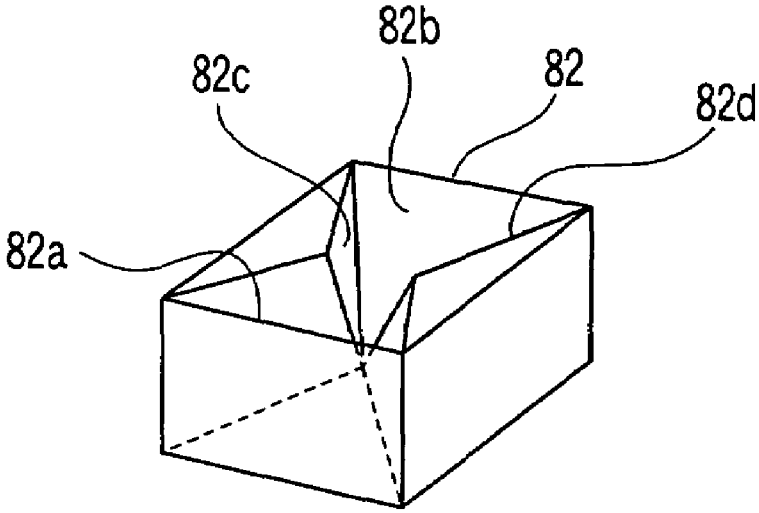
FIG. 9 is a diagram showing an example of the positioning groove in the positioning structure.

One positioning groove 82 is formed into a groove shape which abuts on the wedge shape formed on the tip portion of the carriage pin 56 as shown in FIG. 9. The positioning groove 82 is formed into an acute valley by groove faces 82*a*, 82*b*, and constricted faces 82*c*, 82*d* formed in directions crossing the groove faces 82*a*, 82*b* at right angles. During the abutment of the wedge shape into which the tip portion of the carriage pin 56 is formed on the acute valley in at least the constricted faces 82*c*, 82*d*, the wedge shape of the tip portion of the carriage pin 56 is allowed to rotate on a central axis (Z-axis).

Figure 10:
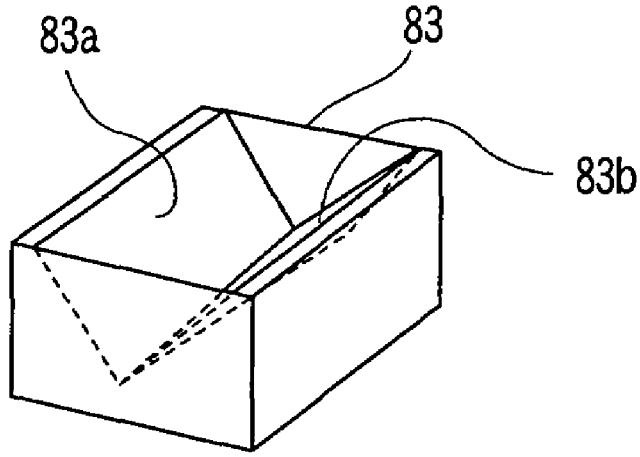
FIG. 10 is a diagram showing an example of the positioning groove in the positioning structure.

The other positioning groove 83 is formed into a groove shape which abuts on the wedge shape of the tip portion of the carriage pin 57 as shown in FIG. 10. The positioning groove 83 is formed substantially into a V-shape by groove faces 83*a*, 83*b*. The positioning groove 83 is moved in an XY-axis plane by a position adjustment mechanism 73, and the position is adjusted.

The tip portion of the carriage pin 56 having a wedge shape is allowed to rotate on the central axis (Z-axis) in the wedge shape in the positioning groove 82 while abutting on the groove. The tip portion of the carriage pin 57 abuts on the positioning groove 83. Accordingly, the positional relation among the resist roller 10, carriage 15, and belt platen 32 is kept.

The positioning holes 60, 61 and the positioning holes 80, 81 shown in FIG. 7 may be changed to one or both of the positioning grooves 82, 83.

What is claimed is:

1. A positioning structure in an image forming apparatus, comprising:

a conveying mechanism which conveys an image forming medium;

a plurality of ink heads which eject ink liquids of different colors with respect to the image forming medium conveyed by the conveying mechanism;

a carriage on which the plurality of ink heads are arranged at predetermined intervals substantially correct in parallel with one another and which is arranged at a position facing and spaced from the conveying mechanism;

a resist roller which regulates a conveying orientation of the image forming medium to introduce the image forming medium into the conveying mechanism;

at least two extending arms which are integrally provided on the carriage and which extend to an introducing side of the conveying mechanism to introduce the image forming medium and which rotatably supports the resist roller; and a plurality of regulation sections which are arranged on the carriage and the conveying mechanism respectively, and which regulate a positional relation between the carriage and the conveying mechanism by mutual contacts.

2. The positioning structure in the image forming apparatus according to claim 1, wherein the resist roller includes a shaft and at least one roller provided on the shaft, and the extending arms each having a first and second end portion, the first end portions of the extending arms integrally provided on each side surface of the carriage, and the second end portions of the extending arms supporting ends of the shaft.

3. The positioning structure in the image forming apparatus according to claim 2, wherein both ends of the shaft pass through the second end portions of the extending arms, and the second end portions of the extending arms rotatably support the shaft.

4. The positioning structure in the image forming apparatus according to claim 2, wherein the second end portions of the extending arms support each end of the shaft via bearings.

5. The positioning structure in the image forming apparatus according to claim 1, further comprising:

at least two first frames which support a supply unit to supply the image forming medium to the conveying mechanism and a discharge unit to discharge the image forming medium and which are provided facing each other; and at least two second frames which are provided inside the respective first frames and which support at least the carriage and which are provided facing each other.

6. The positioning structure in the image forming apparatus according to claim 5, wherein the resist roller has a shaft and a roller provided on the shaft, and the ends of the shaft are rotatably supported by the respective second frames.

7. The positioning structure in the image forming apparatus according to claim 5, wherein the respective first frames are provided outside the respective second frames; and an end portion of each of the second frames is fixed to an end portion of each of the first frames.

8. The positioning structure in the image forming apparatus according to claim 5, wherein rigidities of the respective second frames are higher than those of the respective first frames.

9. The positioning structure in the image forming apparatus according to claim 5, further comprising:

a plurality of connecting frames which connect end portions of the respective second frames and end portions of the respective first frames.

10. The positioning structure in the image forming apparatus according to claim 9, further comprising:

a plurality of abutment portions which are provided on the respective connecting frames; and the carriage laying substantially horizontally.

11. The positioning structure in the image forming apparatus according to claim 10, wherein the carriage has a carriage guide mechanism, the carriage guide mechanism is abuts the carriage at the respective abutment portions.

12. The positioning structure in the image forming apparatus according to claim 1, wherein the conveying mechanism substantially corrects a conveying orientation of the image forming medium introduced by the resist roller with that of the conveying direction of the conveying mechanism.

13. The positioning structure in the image forming apparatus according to claim 1, wherein the respective regulation sections are provided in at least two places in each of the carriage and the conveying mechanism.

14. The positioning structure in the image forming apparatus according to claim 1, wherein the respective regulation sections fit into or abut on each other.

15. The positioning structure in the image forming apparatus according to claim 1, wherein each of the regulation sections has:

at least two rod-shaped members which extending vertically between the carriage and the conveying mechanism; and that are provided in one or both of the carriage and the conveying mechanism;

at least two holes for position regulation which are formed in one or both of the conveying mechanism and the carriage into which the rod-shaped members are fitted.

16. The positioning structure in the image forming apparatus according to claim 15, wherein one of the respective holes for position regulation is formed into a shape as the rod-shape member fits; and the other is formed into an elongated hole shape and as the rod-shape member fits.

17. The positioning structure in the image forming apparatus according to claim 15, wherein each of the regulation sections has a position adjustment mechanism which allows moving/adjusting in the hole for position regulation in at least a horizontal direction.

18. The positioning structure in the image forming apparatus according to claim 1, wherein each of the regulation sections has:

at least two wedge-shaped members which are provided in one or both of the carriage or the conveying mechanism and which extend in a facing direction and a parallel direction with respect to the carriage and the conveying mechanism; and at least tip portions of the at least two wedge-shaped members are formed into wedge shapes; and at least two grooves for position regulation which are provided in one or both of the conveying mechanism or the carriage and onto which the wedge-shaped members abut.

19. The positioning structure in the image forming apparatus according to claim 18, wherein the resist roller includes a shaft and at least one roller provided on the shaft, and one of the grooves for position regulation is provided substantially perpendicular to the shaft.

20. The positioning structure in the image forming apparatus according to claim 18, wherein each of the regulation sections has a position adjustment mechanism in which each of the grooves for position regulation allows the wedge-shaped member to is capable of move/adjust in at least a horizontal direction.

21. The positioning structure in the image forming apparatus according to claim 1, wherein the respective regulation sections are provided in diagonal positions parallel to a plane along which the image forming medium is conveyed in a plane in the carriage; and in diagonal positions parallel to a plane along which the image forming medium is conveyed in a plane in the conveying mechanism.

22. The positioning structure in the image forming apparatus according to claim 1, further comprising:

a moving-up/down mechanism which moves one or both of the carriage and the conveying mechanism in a vertical direction and which is capable of varying a mutual interval between the carriage and the conveying mechanism.

23. A positioning structure in an image forming apparatus, comprising:

a conveying mechanism which conveys an image forming medium;

a plurality of ink heads which eject ink liquid of different colors with respect to the image forming medium conveyed by the conveying mechanism;

a carriage on which the plurality of ink heads are arranged at predetermined intervals substantially correct in parallel with one another and which is arranged at a position facing and spaced from the conveying mechanism;

a resist roller which regulates a conveying orientation of the image forming medium to introduce the image forming medium into the conveying mechanism;

at least two extending arms which are integrally provided on the carriage and which extend to an introducing side of the conveying mechanism to introduce the image forming medium and which rotatably supports the resist roller; and a plurality of regulation sections which are arranged on to the carriage and the conveying mechanism respectively, and which regulate a positional relation between the carriage and the conveying mechanism by mutual contacts, the positioning structure comprising:

positioning the carriage and the conveying mechanism by the contacts among the respective regulation sections;

introducing the image forming medium into the conveying mechanism from the resist roller, conveying the image forming medium by the conveying mechanism; and forming an image on the image forming medium by ejecting the respective ink liquid from the plurality of ink heads;

evaluating superimposed color displacement of the respective colors on the image forming medium on which the image has been formed;

completing the positioning of the carriage and the conveying mechanism, when the superimposed color displacement is in an allowable range as a result of the evaluation of the superimposed color displacement, and readjusting the positioning between the carriage and the conveying mechanism with the respective regulation sections, when the superimposed color displacement is out of the allowable range; and forming the image on the image forming medium again, and evaluating the superimposed color displacement of the respective colors on the image forming medium.

* * * * *